US007228667B2

(12) United States Patent
Bunker, II

(10) Patent No.: US 7,228,667 B2
(45) Date of Patent: Jun. 12, 2007

(54) DOOR SYSTEM FOR A BUILDING

(75) Inventor: Owen Woodruff Bunker, II, Denver, CO (US)

(73) Assignee: Tuff Shed, Inc., Denver, CO (US)

( * ) Notice: Subject to any disclaimer, the term of this patent is extended or adjusted under 35 U.S.C. 154(b) by 333 days.

(21) Appl. No.: 10/707,540

(22) Filed: Dec. 19, 2003

(65) Prior Publication Data

US 2005/0144871 A1 Jul. 7, 2005

(51) Int. Cl.
*E06B 3/70* (2006.01)

(52) U.S. Cl. ..... 52/455

(58) Field of Classification Search ..... 52/784.1, 52/784.15, 455, 200, 19, 474, 475.1, 479, 52/761, 783.1, 783.12, 784.12, 784.13
See application file for complete search history.

(56) References Cited

U.S. PATENT DOCUMENTS

| | | | | | |
|---|---|---|---|---|---|
| 2,220,606 | A * | 11/1940 | Malarkey, et al. | 52/578 |
| 3,121,264 | A * | 2/1964 | Hammar | 52/784.15 |
| 3,153,817 | A * | 10/1964 | Pease, Jr. | 52/784.13 |
| 3,893,273 | A * | 7/1975 | Sailor | 52/291 |
| 4,236,365 | A * | 12/1980 | Wheeler | 52/455 |
| 4,610,119 | A * | 9/1986 | Bench, Sr. | 52/309.3 |
| 5,950,382 | A * | 9/1999 | Martino | 52/311.1 |
| 6,079,183 | A * | 6/2000 | Moyes | 52/784.1 |
| 6,132,540 | A * | 10/2000 | Barber et al. | 156/78 |
| 6,311,454 | B1 * | 11/2001 | Kempel | 52/784.15 |
| 6,453,638 | B2 * | 9/2002 | Chen | 52/784.15 |
| 6,513,558 | B1 * | 2/2003 | Chen | 144/345 |
| 6,892,506 | B2 * | 5/2005 | Skublevitz | 52/784.1 |
| 2001/0003889 | A1 * | 6/2001 | Zen | 52/784.1 |
| 2003/0084639 | A1 * | 5/2003 | Wang Chen | 52/784.1 |
| 2003/0136079 | A1 * | 7/2003 | Ruggie et al. | 52/784.1 |
| 2004/0003559 | A1 * | 1/2004 | Minke et al. | 52/309.9 |
| 2004/0003560 | A1 * | 1/2004 | Lynch et al. | 52/311.1 |
| 2004/0035070 | A1 * | 2/2004 | Chen | 52/309.9 |
| 2004/0035085 | A1 * | 2/2004 | Crittenden | 52/784.1 |
| 2004/0074207 | A1 * | 4/2004 | Yao et al. | 52/784.1 |
| 2004/0172914 | A1 * | 9/2004 | Lancia | 52/784.1 |

* cited by examiner

*Primary Examiner*—Carl Friedman
*Assistant Examiner*—Jessica Laux
(74) *Attorney, Agent, or Firm*—Townsend and Townsend and Crew LLP

(57) ABSTRACT

A door assembly having a structural inner frame that is secured between an interior sheath and an exterior sheath. The inner frame provides rigidity and strength to the door assembly and will not warp or otherwise lose its dimensional integrity regardless of the environment or usage. Both the interior and exterior sheaths add strength and durability once attached to and combined with the inner frame. The internal frame is formed from metal, wood, plastic, composite panels, polystyrene panels or other structural materials. In the preferred embodiment, the inner frame by itself is not structural, it relies on the interior sheath and exterior sheath for its combined strength. The components of the internal frame are secured together by fastening onto the interior sheath and exterior sheath. This allows the components, while structurally supporting one another, to utilize the interior and exterior sheaths to fasten the components to one another.

9 Claims, 3 Drawing Sheets

DOOR SYSTEM FOR A BUILDING

BACKGROUND OF INVENTION

Buildings, and door systems for such buildings, are frequently used for a wide variety of purposes. The term buildings, for purposes of the present invention, includes structural enclosures, that includes not only site built buildings but also modular, prefabricated, kits, or other types of residential, commercial, industrial buildings. Site built buildings are constructed on site while the components for the other buildings are typically fabricated at a manufacturing location, then transported to the building site and assembled. The buildings may be used for residential, commercial, office, as well as for storage, for garage use, for home shops, for light industrial use, heavy industrial use, commercial use, and even for residential occupancy.

These buildings must be durable as well as aesthetically pleasing. The buildings may be used in widely ranging environmental situations, from desert hot temperatures to freezing artic cold. Also, the door systems may receive rough usage so the durability of construction is important. This must be balanced with a door system that is attractive as well.

Typically buildings are used for a wide range of uses, from residential to commercial to industrial, and with a wide range of customer tastes. Thus a door system suitable in one environment or to one customer may not be suitable for another use or customer taste. It is thus important to be able to create a variety of looks for such door systems. However this can greatly drive up the costs of manufacturing and inventory for the manufacturer.

Another critical feature of door systems for such building construction is the cost of such doors. Most buildings are constructed under a tight economic budget. Thus the factors of durability, aesthetics, and customization must be balanced with the economics of providing such doors.

Previous attempts at providing satisfactory doors for buildings have not always been particularly successful. The typical exterior door ranges from a solid panel door for residential use, glass or metal doors for use in office and commercial uses and sheet metal attached to a simple framework or a wooden core door for use in storage, garages or other buildings. The solid panel doors tend to be expensive and not suitable in many production environments, glass or metal office doors are not suitable in many environments and sheet metal doors are either flimsy and do not survive very well in normal usage, or extremely heavy and expensive. Also many doors, particularly those used in storage buildings, sheds and the like are simply a sheet of exterior building materials attached to a wooden framework. For example, a typical door for a shed is simply a sheet of plywood fastened to a wooden two by four frame.

The typical wooden door, either solid panel or hollow core, does not weather well in many environments. Also, these doors will warp, decay or delaminate as well. This requires repair or replacement of the doors at relatively frequent intervals.

Thus a need exists for a sound and attractive door system for use in buildings and that are relatively inexpensive.

SUMMARY OF INVENTION

The present invention solves these and other problems by providing a unique door that is not only high strength and durable but is economical and easily manufactured. The door of the present invention is also able to be attractive, easily customized and accommodate usage in many differing situations.

A preferred embodiment of the present invention includes a structural inner frame that is secured between an interior sheath and an exterior sheath. The inner frame adds to the rigidity and strength of the door assembly and will not warp or otherwise lose its dimensional integrity regardless of the environment or usage.

The internal frame of the preferred embodiment of the present invention is formed from metal, wood, plastic, polystyrene or other structural materials. In a preferred embodiment, the internal frame is formed from steel tubing that is easily cut to size.

The components of the internal frame in a preferred embodiment are secured together by fastening onto the sheathing on both sides. Prior frames required the components to be fastened to one another prior to the door assembly which increased the cost and manufacturing process of the doors. This embodiment allows the components, while structurally supporting one another, to utilize the sheaths on both sides of the internal frame to fasten the components to one another. Both the interior and exterior sheaths add strength and durability once attached to and combined with the inner frame.

The interior sheath is formed from oriented strand board (OSB), tempered hardboard plywood siding, finish or construction grade plywood, metal sheets, plastic panels or other suitable materials. The interior sheath may be pre-painted prior to assembly or painted, stained or otherwise coated after assembly if necessary.

The exterior sheath is formed from tempered hardboard plywood siding, plywood, vinyl, metal siding, plastic panels, or other materials that are suitable for use in differing environments and usage. The exterior sheath may also be pre-painted or otherwise treated either prior to assembly or after assembly has occurred. In a preferred embodiment, the exterior sheath extends beyond the dimensions of the internal frame and the interior sheath to minimize environmental intrusion when the door is closed.

Exterior trim components may be attached onto the exterior sheath to improve the aesthetics of the door assembly. The trim may be of any configuration or design as desired.

The assembly process of the door of a preferred embodiment provides an efficient and economical manufacturing process. The components of the internal frame are laid out in a jig on a table or other surface. The interior sheath is placed over the frame components and lined up accordingly. Then the interior sheath is fastened directly to the frame components by screws, nails, staples, fasteners, adhesives or other fastening devices. The assembled frame components and interior sheath are flipped over and the exterior sheath is placed onto the components and lined up appropriately. The exterior sheath is then fastened onto the components by screws, nails, staples, fasteners, adhesives or other fastening devices. The exterior trim can then be fastened onto the exterior sheath, if it was not previously secured to it. Apertures can be made into the exterior sheath, interior sheath, or frame at this time, or prior to the assembly process for hinges, latches or other hardware as well as for windows in the door.

These and other features of the present invention will be evident from the ensuring detailed description of preferred embodiments and from the drawings.

DETAILED DESCRIPTION

The present invention, in a preferred embodiment, provides a door system for use in buildings such as but not limited to portable buildings, storage buildings, pre-manufactured buildings, industrial building, commercial buildings and other buildings. A preferred embodiment of the present invention is described below. It is to be expressly understood that this descriptive embodiment is provided for explanatory purposes only, and is not meant to unduly limit the scope of the present invention as set forth in the claims. Other embodiments of the present invention are considered to be within the scope of the claimed inventions, including not only those embodiments that would be within the scope of one skilled in the art, but also as encompassed in technology developed in the future.

The descriptive embodiments provided herein describe door systems for use in portable buildings. It is to be expressly understood that the door system have application for use with other types of buildings as well, particularly where the building is exposed to the environment and where cost is a factor.

Figure 1:
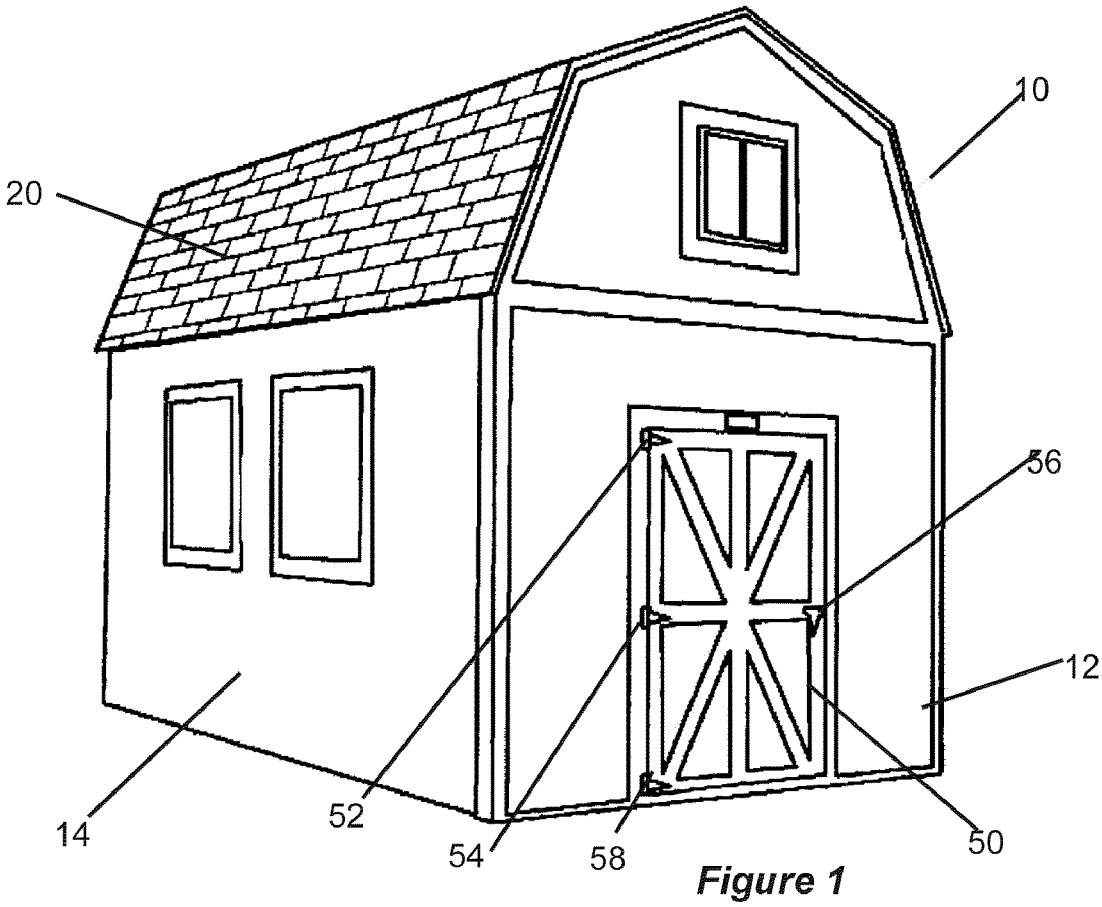
FIG. 1 is an illustration of a perspective view of an exemplary portable building using a door of a preferred embodiment of the present invention.

An example of a portable building that uses a door system of a preferred embodiment of the present invention is shown in FIG. 1. The building 10 includes four walls 12, 14, 16, 18, (not all shown), a roof 20 and door 50. The door is mounted within an opening in any of the walls (such as wall 12 as shown in FIG. 1) by hinges 52, 54, 58 and latch 56. It is to be clearly understood that the hinges may be hidden, mounted on the interior, or the door mounted through other hardware. Also, the building 10 may be of any shape, size or architecture as desired under the present invention.

Figure 2:
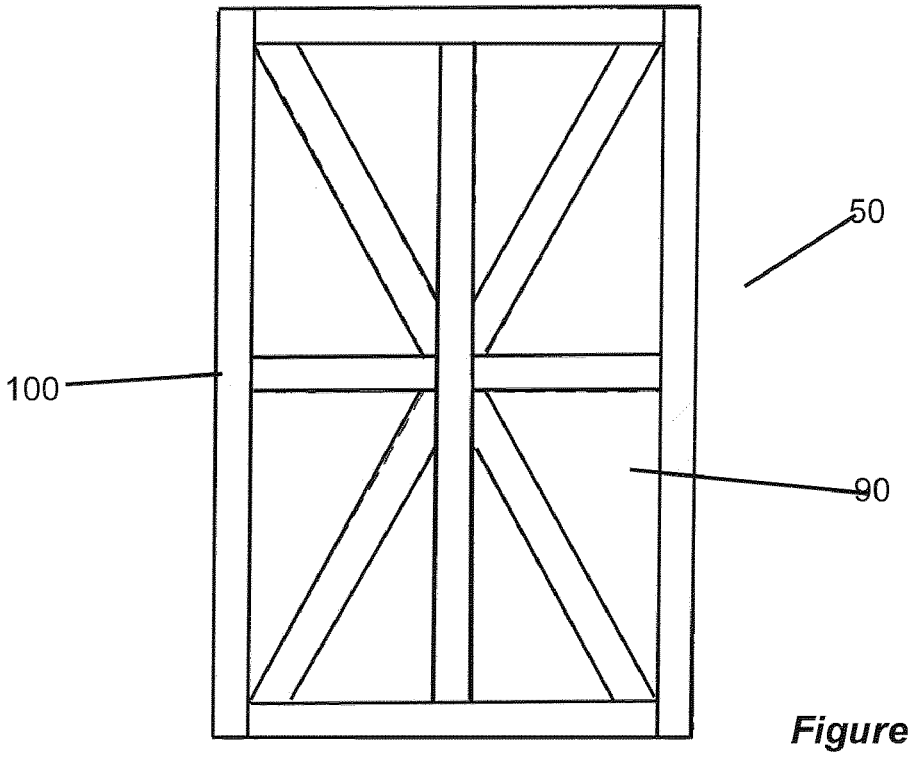
FIG. 2 is an illustration of a front view of a door of a preferred embodiment of the present invention.
Figure 3:
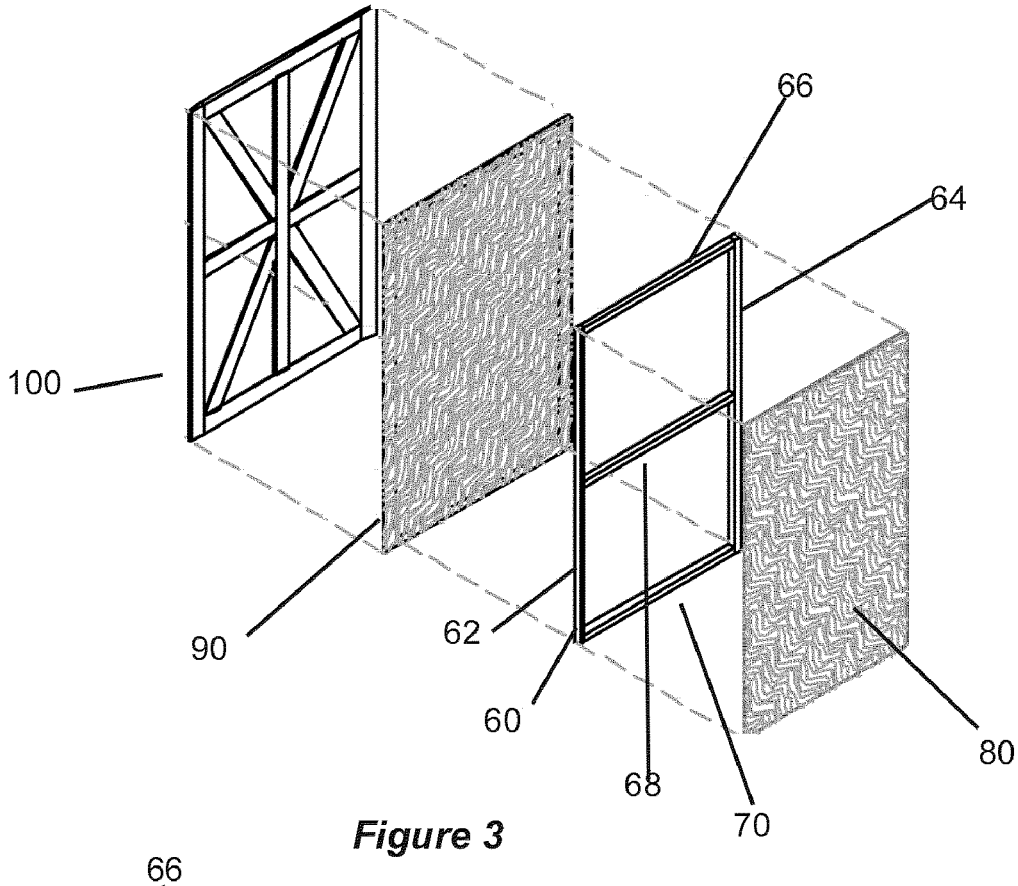
FIG. 3 is an exploded view of the door of the embodiment of FIG. 2.
Figure 4:
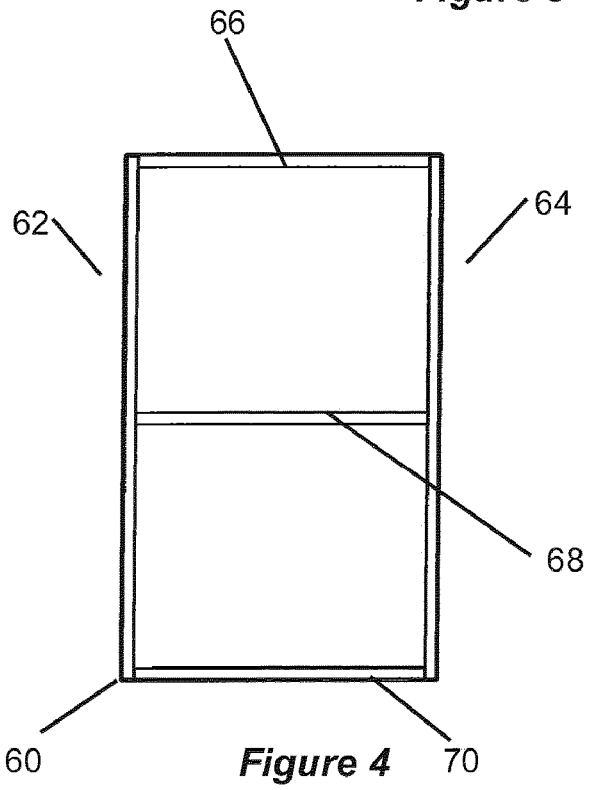
FIG. 4 is a view of the internal frame of the door of the embodiment of FIG. 2.
Figure 5:
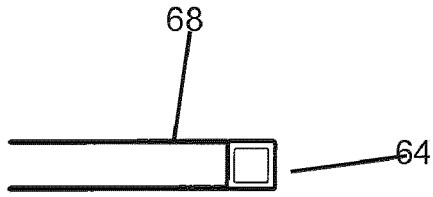
FIG. 5 is a cross-sectional view of the internal frame of FIG. 4.
Figure 6:
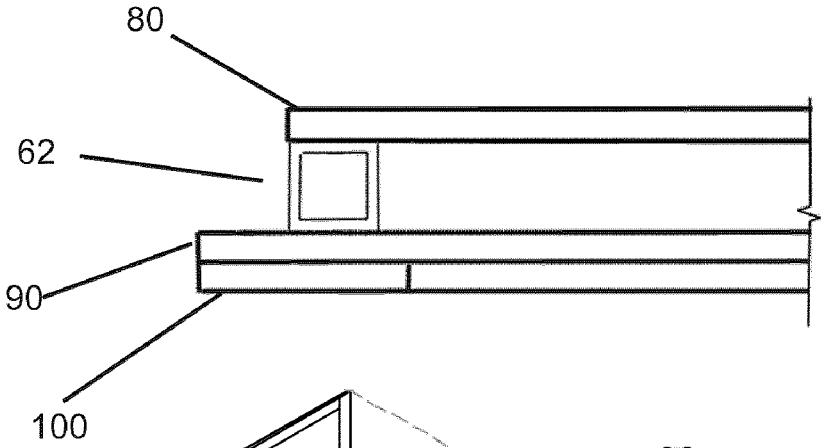
FIG. 6 is a cross-sectional view of the door of the embodiment of FIG. 2.

A preferred embodiment of the present invention provides a door 50 shown in FIGS. 2-6 that provides strength, durability, customization as well as economical and easily assembled. The door 50, in this preferred embodiment is illustrated in FIGS. 2 and 3. The door 50 includes an internal frame 60, an interior sheath 80, and an exterior sheath 90. In this preferred embodiment, the door 50 also includes exterior trim 100, but could also omit trim as well.

The internal frame 60 includes structural components 62 70. The components can include additional components or fewer components in other embodiments of the present invention. In this embodiment, internal frame 60 includes side members 62, 64 and cross members 66, 68, 70. In this preferred embodiment, the side members and the cross members are formed of the same base material. These components in this preferred embodiment are formed of structural thin walled metal tubing. Other embodiments use wood, plastic, aluminum, polystyrene, or other lightweight, strong structural materials. Also, in another preferred embodiment, the internal frame may also be formed as a solid internal panel.

The interior sheath 80 is formed of oriented strand board (OSB), tempered hardboard tempered siding, finish or construction grade plywood, plastic, metal, vinyl, panel, or other materials that are usable as layer that will be exposed to some amount of environmental weathering. In the preferred embodiment, the interior sheath is a laminated plywood panel. The outer dimensions of the interior sheath are substantially the same as the outer dimensions of the internal frame 60 so the frame and sheath match as the sheath is attached to the internal frame.

The exterior sheath 90, in the preferred embodiment, is formed from an exterior siding material, such as of oriented strand board (OSB), tempered hardboard tempered siding, finish or construction grade plywood, plastic, metal, vinyl, panel, or other materials that are suitable for exterior environmental use. The outside dimensions of the exterior sheath extend outside of the internal frame 60 when secured to the internal frame. This minimizes environmental damage as well as exposure to the interior of the building. A unique feature in a preferred embodiment of the present invention is the construction of the internal frame 60. In this preferred embodiment, the components 62 70 are not attached directly to one another. Instead the internal frame is formed by the attachment of the interior sheath 80 and the exterior sheath 90 to the internal frame components. This increases the efficiency of the assembly process while providing structural rigidity to the door. The interior sheath and exterior sheath are secured to the frame components by fasteners such as screws, nails, adhesive or other structural fastening methods. It is to be expressly understood that other assembly methods could be used as well. For instance, the components of the internal frame can be welded, bolted or otherwise secured together prior to the attachment of the interior and exterior sheathes. Also, the internal frame can be formed of a single unitary construction or composite material.

The assembly process in the preferred embodiment is capable of being easily performed by a single individual or in an automated process. In this process, the internal frame components are placed in a jig so that they are in the appropriate configuration. Then the interior sheath is placed onto the components and lined up relative to the components. Screw fasteners, nails, adhesives or other fastening devices are then secured through the interior sheath into the frame components to fasten the interior sheath to the components and thus forming the internal frame. The assembled internal frame and interior sheath are flipped over, and the exterior sheath is placed onto the internal frame and lined up accordingly. The exterior sheath is then secured to the internal frame by screws, nails, adhesives or other fastening devices. Apertures may also be formed in the exterior sheath, interior sheath and frame for hinges, latching devices, windows or other openings if desired. The door is ready at this point to be installed onto the portable building, or kitted for future building assembly.

Figure 7:
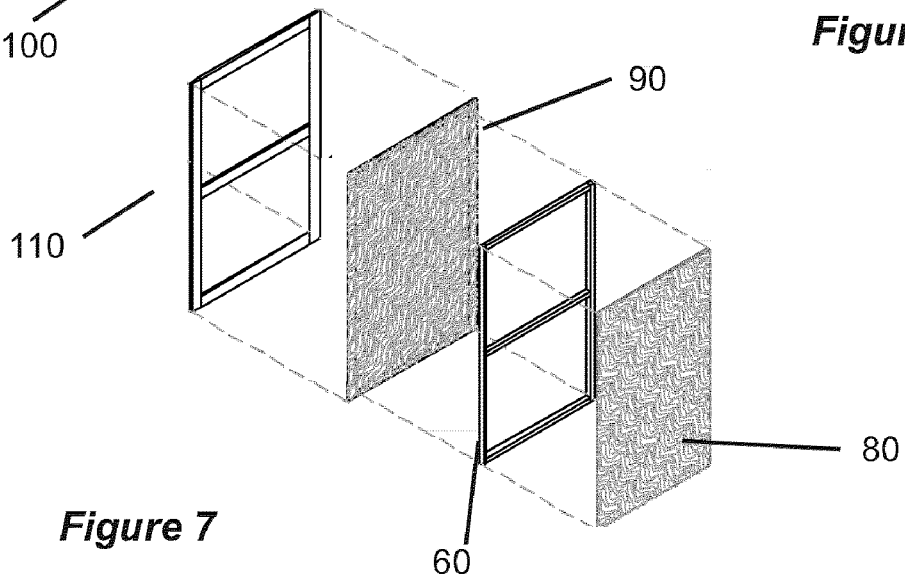
FIG. 7 is an exploded view of an alternate embodiment of a door of the present invention.
Figure 8:
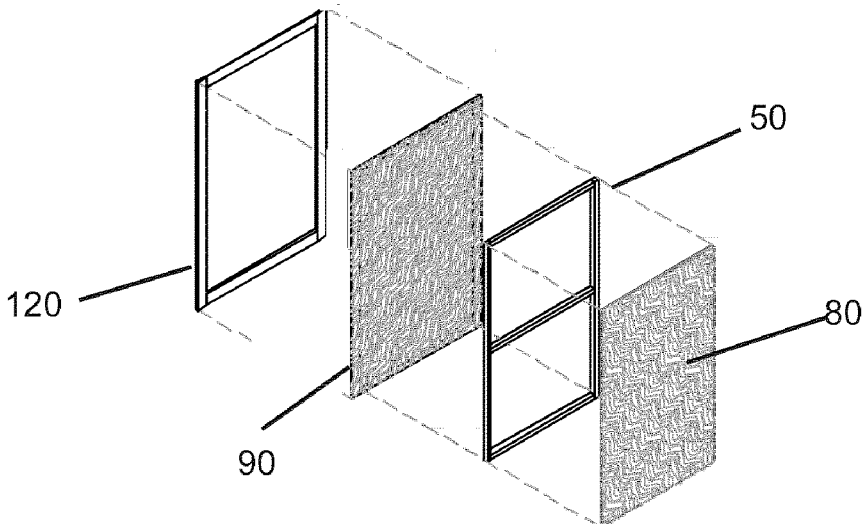
FIG. 8 is an exploded view of another alternative embodiment of a door of the present invention.

In a preferred embodiment of the present invention, exterior trim pieces are mounted to the exterior sheath to increase the attractiveness of the door. One preferred embodiment of the exterior trim 100 is illustrated in FIGS. 2 and 3. The trim 100 can be fastened onto the exterior sheath during the assembly process discussed above. Other examples of trim 110, 120 are shown in FIGS. 7 and 8 respectively.

The interior and exterior sheaths can be prepainted, stained or otherwise provided with a protective coating prior to the assembly process or afterwards, as desired. Also, the components of the internal frame may also be formed of a corrosion resistant material to provide longevity from environmental damage.

The unique door assembly provides a high strength, durable door that is economical and easily manufactured. The assembly process enables the doors to be efficiently manufactured. The above descriptive embodiments are provided to explain exemplary features of the claimed inventions but are not meant to limit the scope of the claimed inventions. Other embodiments are also considered to be within the scope of the present invention as set forth in the claims.

The invention claimed is:

1. A door system for a building, said door system comprising:

a rigid internal frame having at least four tubular members that define a shape for the door system, wherein each tubular member comprises four continuous outer walls that define an open interior;

an interior sheath attached to said internal frame, wherein the interior sheath has an outer periphery defined by at least four outer edges;

an exterior sheath attached to said internal frame, wherein the exterior sheath has an outer periphery defined by at least four outer edges; and exterior trim attached on said exterior sheath;

wherein at least two of the outer edges of the exterior sheath extend beyond the internal frame, and wherein the internal frame positioned between the interior sheath and exterior sheath forms a generally rigid door that resists bowing; and wherein the internal frame comprises tubular metal members disposed in a rectangular configuration with exterior edges. and wherein the outer edges of said interior sheath are flush with the exterior edges of the internal frame.

2. The door system of claim 1 wherein said internal frame is constructed of metal, and further comprises:

at least one central tubular member which extends between two of the outer tubular metal components, wherein said at least one central tubular member is in addition to the four tubular members that define the shape for the door system.

3. The door system of claim 1 wherein said internal frame includes:

at least one vertical component and at least one horizontal component that are part of said at least four tubular members that define the shape for the door; and an attachment mechanism for attaching said at least one vertical component and said at least one horizontal component to one another.

4. The door system of claim 3 wherein said attachment mechanism includes:

fastening mechanisms attaching said at least one vertical component and said at least one horizontal component to at least one of said exterior sheath and said interior sheath.

5. The door system of claim 1 wherein the tubular members define an outer periphery, wherein the outer edges of said exterior sheath extend beyond the outer periphery of said internal frame while the outer edges of said interior sheath are the same dimensions as the outer periphery of said internal frame.

6. A method for assembling a door for a building, said method including the steps of:

placing internal frame components on a surface with the internal frame components being unattached to each other, wherein the internal frame components each comprise tubular members with continuous outer walls that define an open interior;

placing an interior sheath on top of the internal frame components while the internal frame components are on the surface;

securing the interior sheath to the internal frame components while the internal frame components are on the surface;

reversing the assembled internal frame components and interior sheath so the internal frame components are exposed; and securing an exterior sheath to the internal frame components, wherein the extension sheath has at least two outer edges that extend beyond outer edges of the internal frame.

7. The method of claim 6 wherein said method further includes:

fastening trim components to the exterior sheath, and wherein the internal frame components comprise tubular metal sections.

8. A door system for a building, said door system comprising:

a rigid internal frame having at least four tubular members that define a shape for the door system, wherein each tubular member comprises four continuous outer walls that define an open interior;

an interior sheath attached to said internal frame, wherein the interior sheath has an outer periphery defined by at least four outer edges;

an exterior sheath attached to said internal frame, wherein the exterior sheath has an outer periphery defined by at least four outer edges; and exterior trim attached on said exterior sheath;

wherein at least two of the outer edges of the exterior sheath extend beyond the internal frame, and wherein the internal frame positioned between the interior sheath and exterior sheath forms a generally rigid door that resists bowing;

wherein said internal frame is constructed of metal, and further comprises:

at least one central tubular member which extends between two of the outer tubular metal components, wherein said at least one central tubular member is in addition to the four tubular members that define the shape for the door system.

9. A door system for a building, said door system comprising:

a rigid internal frame having at least four tubular members that define a shape for the door system, wherein each tubular member comprises four continuous outer walls that define an open interior;

an interior sheath attached to said internal frame, wherein the interior sheath has an outer periphery defined by at least four outer edges;

an exterior sheath attached to said internal frame, wherein the exterior sheath has an outer periphery defined by at least four outer edges; and exterior trim attached on said exterior sheath;

wherein at least two of the outer edges of the exterior sheath extend beyond the internal frame, and wherein the internal frame positioned between the interior sheath and exterior sheath forms a generally rigid door that resists bowing, wherein the tubular members define an outer periphery, wherein the outer edges of said exterior sheath extend beyond the outer periphery of said internal frame while the outer edges of said interior sheath are the same dimensions as the outer periphery of said internal frame.

* * * * *